US010021488B2

(12) United States Patent
Stolz et al.

(10) Patent No.: US 10,021,488 B2
(45) Date of Patent: Jul. 10, 2018

(54) VOICE COIL WIRE CONFIGURATIONS

(71) Applicant: Sonos, Inc., Santa Barbara, CA (US)

(72) Inventors: Petr Stolz, Shenzhen (CN); Richard Warren Little, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 125 days.

(21) Appl. No.: 14/804,208

(22) Filed: Jul. 20, 2015

(65) Prior Publication Data

US 2017/0026757 A1 Jan. 26, 2017

(51) Int. Cl.
*H04R 9/04* (2006.01)
*H04R 31/00* (2006.01)
*H04R 1/06* (2006.01)

(52) U.S. Cl.
CPC ..... *H04R 9/046* (2013.01); *H04R 1/06* (2013.01); *H04R 31/006* (2013.01); *H04R 9/043* (2013.01); *H04R 9/045* (2013.01)

(58) Field of Classification Search
CPC ... H04R 9/00; H04R 9/02; H04R 9/04; H04R 9/045; H04R 9/046; H04R 9/047; H04R 9/06; H04R 9/025; H04R 9/043; H04R 1/06; H04R 31/006; H04R 2209/041
See application file for complete search history.

(56) References Cited

U.S. PATENT DOCUMENTS 4,539,442 A * 9/1985 Puls ..... H04R 9/045 174/117 FF
4,737,992 A 4/1988 Latham-Brown et al.
5,040,221 A * 8/1991 Edwards ..... H04R 9/045 381/409
5,249,236 A * 9/1993 Sakamoto ..... H04R 9/045 381/409
5,440,644 A 8/1995 Farinelli et al.
5,761,320 A 6/1998 Farinelli et al.
(Continued)

FOREIGN PATENT DOCUMENTS

EP 1389853 A1 2/2004
EP 2028876 A1 2/2009
(Continued)

OTHER PUBLICATIONS

AudioTron Quick Start Guide, Version 1.0, Mar. 2001, 24 pages.
(Continued)

*Primary Examiner* — Oyesola C Ojo
(74) *Attorney, Agent, or Firm* — McDonnell Boehnen Hulbert & Berghoff LLP

(57) ABSTRACT

Embodiments for voice coil wire configurations are provided. In one example, a voice coil wire configuration may involve a wire that is flexible in a first plane and substantially inflexible in a second plane. The wire may be a flat wire configured to be flexible in the first plane and substantially inflexible in the second plane. The wire may be coupled to the voice coil in an orientation such that the first plane of the wire is aligned with an axial direction of the voice coil such that wire flex caused by axial movement of the voice coil during operation of the loudspeaker may be substantially in the first plane, and minimally in the second plane. In some examples, the wire may be intermediately adhered to one or more other components of the loudspeaker between the input terminal and the voice coil.

20 Claims, 5 Drawing Sheets

(56) References Cited

U.S. PATENT DOCUMENTS

| | | | | |
|---|---|---|---|---|
| 5,834,702 | A * | 11/1998 | Pryce | B60R 16/0207 174/117 FF |
| 6,032,202 | A | 2/2000 | Lea et al. | |
| 6,469,633 | B1 | 10/2002 | Wachter | |
| 6,778,869 | B2 | 8/2004 | Champion | |
| 7,295,548 | B2 | 11/2007 | Blank et al. | |
| 7,447,327 | B2 * | 11/2008 | Kitamura | H04R 1/06 381/409 |
| 7,483,538 | B2 | 1/2009 | McCarty et al. | |
| 7,571,014 | B1 | 8/2009 | Lambourne et al. | |
| 7,630,501 | B2 | 12/2009 | Blank et al. | |
| 7,643,894 | B2 | 1/2010 | Braithwaite et al. | |
| 7,853,341 | B2 | 12/2010 | McCarty et al. | |
| 7,987,294 | B2 | 7/2011 | Bryce et al. | |
| 8,031,896 | B2 | 10/2011 | Chick et al. | |
| 8,031,897 | B2 | 10/2011 | Bastyr et al. | |
| 8,045,952 | B2 | 10/2011 | Qureshey et al. | |
| 8,103,009 | B2 | 1/2012 | McCarty et al. | |
| 8,189,841 | B2 | 5/2012 | Litovsky et al. | |
| 8,234,395 | B2 | 7/2012 | Millington et al. | |
| 8,345,892 | B2 | 1/2013 | Jung et al. | |
| 8,483,853 | B1 | 7/2013 | Lambourne | |
| 8,638,968 | B2 | 1/2014 | Gladwin | |
| 8,675,899 | B2 | 3/2014 | Jung | |
| 8,811,648 | B2 | 8/2014 | Pance et al. | |
| 8,934,657 | B2 | 1/2015 | Wilk | |
| 9,363,593 | B2 | 6/2016 | Kawka et al. | |
| 2002/0124097 | A1 | 9/2002 | Isely et al. | |
| 2003/0133586 | A1 * | 7/2003 | Ko | H04R 1/06 381/410 |
| 2004/0008860 | A1 * | 1/2004 | Wu | H04R 1/06 381/404 |
| 2007/0142944 | A1 | 6/2007 | Goldberg et al. | |
| 2012/0121092 | A1 | 5/2012 | Starobin | |
| 2013/0202149 | A1 | 8/2013 | Yoon | |
| 2013/0315429 | A1 | 11/2013 | Parker et al. | |
| 2016/0014524 | A1 * | 1/2016 | Takada | H04R 7/20 381/398 |

FOREIGN PATENT DOCUMENTS

| | | |
|---|---|---|
| WO | 2003093950 A2 | 11/2003 |
| WO | 2003101149 | 12/2003 |

OTHER PUBLICATIONS

AudioTron Reference Manual, Version 3.0, May 2002, 70 pages.
AudioTron Setup Guide, Version 3.0, May 2002, 38 pages.
International Searching Authority, International Search Report and Written Opinion dated Nov. 8, 2016, issued in connection with International Application No. PCT/US2016/042834, filed on Jul. 18, 2016, 12 pages.
Jo et al., "Synchronized One-to-many Media Streaming with Adaptive Playout Control," Proceedings of SPIE, 2002, pp. 71-82, vol. 4861.
"Denon 2003-2004 Product Catalog," Denon, 2003-2004, 44 pages.
United States Patent and Trademark Office, U.S. Appl. No. 60/490,768, filed Jul. 28, 2003, entitled "Method for synchronizing audio playback between multiple networked devices," 13 pages.
United States Patent and Trademark Office, U.S. Appl. No. 60/825,407, filed Sep. 12, 2003, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.

* cited by examiner

VOICE COIL WIRE CONFIGURATIONS

FIELD OF THE DISCLOSURE

The disclosure is related to consumer goods and, more particularly, to methods, systems, products, features, services, and other elements directed to media playback or some aspect thereof.

BACKGROUND

In some media playback devices, a speaker is driven when an audio signal is provided from an audio source to the speaker via wires connecting the audio source to a voice coil of the speaker. In such media playback devices, a durability of the media playback device may depend on a reliable connection of the wire between the voice coil and the audio source.

Additionally, an electromagnetic field is created around the wires whenever an audio signal passes through the wires. The electromagnetic field may disrupt operations of other components, such as a wireless communication interface. Accordingly, a reliability of the media playback device may depend on an ability to account for the electromagnetic field created around the wires when designing the media playback system.

BRIEF DESCRIPTION OF THE DRAWINGS

Features, aspects, and advantages of the presently disclosed technology may be better understood with regard to the following description, appended claims, and accompanying drawings where:

Figure 1A:
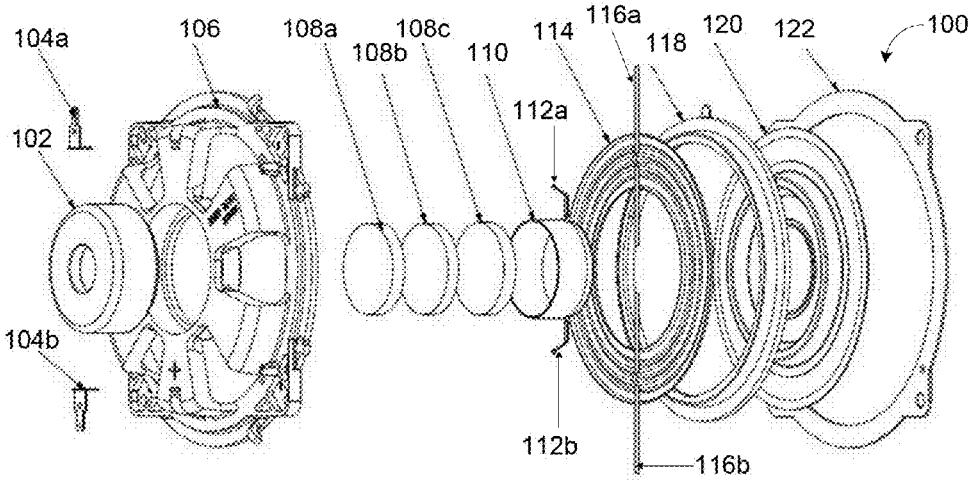
FIG. 1A shows example components of an illustrative loudspeaker assembly.

The drawings are for the purpose of illustrating example embodiments, but it is understood that the inventions are not limited to the arrangements and instrumentality shown in the drawings.

DETAILED DESCRIPTION

I. Overview

Examples described herein involve voice coil wire configurations that provide a durable connection between a voice coil and an input terminal. The example voice coil wire configurations may further provide contained movement of wire connections during operation of a respective loudspeaker when an audio signal is provided via the input terminal to the voice coil. The example voice coil wire configurations may also allow for a shallower loudspeaker assembly.

In one example, the voice coil wire configuration may involve a wire that is flexible in a first plane and substantially inflexible in a second plane. In one case, the wire may be a flat wire configured to be flexible vertically (in the first plane) and substantially inflexible laterally (in the second plane). The voice coil wire configuration may involve the wire coupled to the voice coil in an orientation such that the first plane of the wire is aligned with an axial direction of the voice coil. This way, wire flex caused by axial movement of the voice coil during operation of the loudspeaker may be substantially in the first plane, and minimally in the second plane. Given that the wire is configured to be flexible in the first plane (and substantially inflexible in the second plane), a longevity of the wire and durability of the connection between the voice coil and the input terminal may be improved.

Additionally, wire flex that is substantially in the first plane and minimally in the second plane may provide wire movements from axial movement of the voice coil during operation of the loudspeaker that are laterally contained. In other words, "jump-rope" effects of the wire during operation of the loudspeaker may be minimized. In some voice coil wire configurations in which the input terminals are substantially adjacent, the laterally contained wire movement may allow input terminals to be positioned closer together, thereby offering additional flexibility in playback device designs and configurations.

Further, the flat wire orientated such that the first plane of the wire is aligned with an axial direction of the voice coil may also allow for less clearance between a basket or frame of the loudspeaker and a diaphragm of the loudspeaker. In other words, voice coil connection configurations as described above may further allow for a shallower loudspeaker assembly, thereby offering additional flexibility in playback device designs and configurations.

In some examples, the wire that is flexible in a first plane and substantially inflexible in a second plane may be intermediately adhered to one or more other components of the loudspeaker between the input terminal and the voice coil. In one case, the wire may be intermediately adhered to a spider of the loudspeaker. In another case, the wire may be intermediately adhered to the diaphragm of the loudspeaker. In a further case, the wire may be intermediate adhered to both the spider and diaphragm of the loudspeaker. Other examples are also possible.

In some examples, assembly of the loudspeaker may involve adhering the wire to the spider and/or diaphragm, followed by providing a sub-assembly of the voice coil and the spider and/or diaphragm, during which a first end of the wire is conductively coupled to a lead of the voice coil. The sub-assembly may then be coupled to a sub-assembly of the speaker basket and a magnetic structure such that the voice coil is magnetically suspended about a central portion of the magnetic structure, and a second end of the wire is conductively coupled to the input terminal. Other examples of loudspeaker assembly are also possible.

As indicated above, examples described herein involve a voice coil wire configurations. In one aspect, a loudspeaker is provided. The loudspeaker includes a voice coil magnetically suspended about a magnetic structure and configured to move axially about the magnetic structure in response to an electric signal provided to the voice coil, and a wire flexible in a first plane and substantially inflexible in a second plane, The wire conductively couples an input terminal to the voice coil such that the wire flexes in the first plane during axial movement of the voice coil.

In another aspect, a method is provided. The method involves providing a speaker basket structurally coupled to an input terminal and a magnetic structure, suspending a voice coil about the magnetic structure, and conductively coupling the voice coil and the input terminal using a wire that is flexible in a first plane and substantially inflexible in a second plane, such that the wire flexes in the first plane when an electrical signal at the input terminal causes the voice coil to move in an axial direction about the magnetic structure.

In a further aspect, a loudspeaker is provided. The loudspeaker includes an input terminal, a speaker basket structurally coupled to the input terminal, a magnetic structure structurally coupled to the speaker basket, a voice coil magnetically suspended about the magnetic structure and configured to move axially about the magnetic structure in response to an electric signal provided to the voice coil, and a wire flexible in a first plane, and substantially inflexible in a second plane. The wire conductively couples the input terminal to the voice coil such that the wire flexes in the first plane during axial movement of the voice coil.

While discussions of examples herein may generally be directed to a speaker terminal, one of ordinary skill in the art will appreciate that the examples and variations of the examples can also be implemented and/or utilized for other purposes as well.

II. Example Components and Methods for Loudspeaker Assemblies

As indicated above, examples described herein involve voice coil wire configurations for a loudspeaker. FIG. 1A shows example components of an illustrative loudspeaker assembly 100. As shown, the loudspeaker assembly 100 includes a bottom cup 102, input terminals 104*a* and 104*b*, a speaker basket 106, a magnet spacer 108*a*, a magnet 108*b*, a magnet washer 108*c*, a voice coil 110, voice coil leads 112*a* and 112*b* of the voice coil 110, a spider 114, wires 116*a* and 116*b* coupled to the spider 114, a suspension ring 118, a cone assembly 120, and a gasket 122.

The speaker basket 106 may be a molded or machined structure designed to structurally hold and/or support the other example components of the illustrative loudspeaker assembly 100. As shown, the speaker basket 106 may be structurally coupled to the input terminals 104*a* and 104*b*. The input terminals 104*a* and 104*b* may be structurally coupled to the speaker basket 106 by being pressed, or snapped into the speaker basket 106. In one example, the input terminals 104*a* and 104*b* may be configured to conduct electric signals from an audio source from an external side of the speaker basket 106 to one or more components of an internal side of the speaker basket 106. As shown, the input terminal 104*b* may be configured for a positive ("+") signal input, while the input terminal 104*a* may be configured for a negative ("−") signal input. Other examples are also possible.

The speaker basket 106 may further be structurally coupled to a magnetic structure. The bottom cup 102, magnet spacer 108*a*, magnet 108*b*, and magnet washer 108*c* may be assembled to form a magnetic structure. In one example, the magnet spacer 108*a* may be glued to the magnet spacer 108*a*, the magnet spacer 108*a* may be glued to the magnet 108*b*, and the magnet 108*b* may be glued to the magnet washer 108*c*. In one case, each of the gluing steps may be performed using different jigs. In one instance, one or more of the gluing steps of the magnetic structure may alternatively involve adhering of two or more of the magnetic structure components using epoxy. The magnetic structure may be configured to be structurally coupled to the speaker basket 106. Other examples are also possible.

The voice coil 110 may be configured to be magnetically suspended about the magnetic structure and configured to move axially about the magnetic structure in response to an electric signal provided to the voice coil. As shown, the voice coil 110 has voice coil leads 112*a* and 112*b*. In one example, voice coil lead 112*a* may be configured to receive a negative electric signal while voice coil lead 112*b* may be configured to receive a positive electric signal. Accordingly, the voice coil 100 may be configured to move axially about the magnetic structure in response to electric signals received by the voice coil leads 112*a* and 112*b*.

The spider 114 of the loudspeaker assembly 100 may be configured to maintain a position of the voice coil 110 about the magnetic structure when no electric current is provided to the voice coil 110. An outer rim of the spider 114 may be structurally coupled to the speaker basket 106 either directly or via the suspension ring 118. An inner rim of the spider may be coupled to the voice coil 110 directly and/or via the cone assembly 120. As shown, the wires 116*a* and 116*b* are each at least partially adhered to the spider 114. The wire 116*a* may couple the input terminal 104*a* to the voice coil lead 112*a*, and the wire 116*b* may couple the input terminal 104*b* to the voice coil lead 112*b*.

In one example, the wires 116*a* and 116*b* may be wires that are flexible in a first plane and substantially inflexible in a second plane. In one case, the wires 116*a* and 116*b* may be flat wires that are flexible in the first plane and substantially inflexible in the second plane. In one example, such flat wire may be designed and/or reinforced to endure regular flex in the first plane. In one case, the wires 116*a* and 116*b* may each be laminated within a non-conductive substance. The non-conductive lamination of the wires 116*a* and 116*b* may prevent undesirable short-circuiting between components during operation of the loudspeaker assembly 100.

As shown in FIG. 1A, a direction of the axial movement of the voice coil 110 about the magnetic structure during operation of the loudspeaker assembly 100 may be within the first plane. In other words, the wires 116*a* and 116*b* may be flexible in the same direction as the movement of the voice coil 110 during operation of the loudspeaker assembly 100. As such, the use of flat wires for the wires 116*a* and 116*b*, configured such that the direction of the axial movement of voice coil 110 about the magnetic structure is within the first plane, may benefit a durability of the connections between the input terminals 104*a* and 104*b*, and the voice coil leads 112*a* and 112*b*, respectively.

The cone assembly 120 may include a speaker cone (or "diaphragm") and a surround. In some cases, a cone assembly may also include a dust cap, but in the speaker cone assembly 120 shown in FIG. 1A, the speaker cone is a continuous speaker cone having a continuous central portion and an outer rim. The voice coil 110 may be coupled to the central portion of the speaker cone, on an inner (and/or lower) surface of the speaker cone. The outer rim of the speaker cone may be structurally coupled to an inner rim of the surround. An outer rim of the surround may further be structurally coupled to the speaker basket 106 directly or via the suspension ring 118.

Figure 1B:
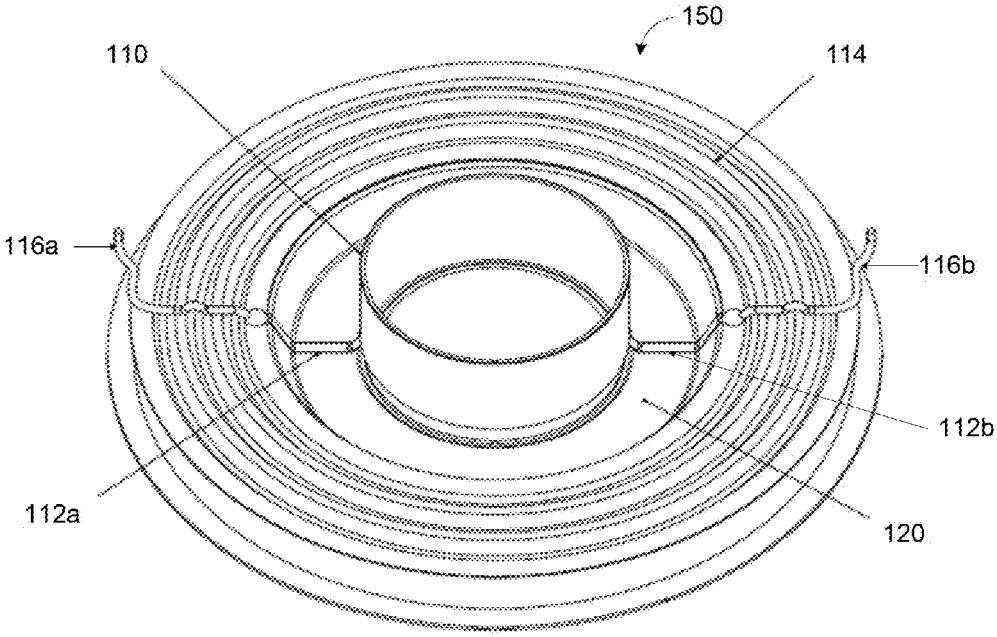
FIG. 1B shows an example sub-assembly of the illustrative loudspeaker assembly.

FIG. 1B shows an example loudspeaker sub-assembly 150 that includes the cone assembly 120, the spider 114, the wires 116*a* and 116*b*, the voice coil 110, and the voice coil leads 112*a* and 112*b*. As shown, an inner rim of the spider 114 may be structurally coupled, concentrically about the voice coil 110, to the inner surface of the speaker cone, the wire 116*a* may be conductively coupled to the voice coil lead 112*a*, and the wire 116*b* may be conductively coupled to the voice coil lead 112*b*. As indicated above, the inner rim of the spider 114 may alternatively (or additionally) be structurally coupled to the voice coil 110.

Referring back to FIG. 1A, the suspension ring 118 may be provided as a circumferential spacer between the cone assembly 120 and the spider 114 and such that the cone assembly 120 and the spider 114 are structurally coupled to the speaker basket, as indicated above. The gasket 122 may be provided to structurally hold and/or support the other components of the loudspeaker assembly 100 within the speaker basket 106 when attached to the speaker basket 106. The gasket 122 may be screwed, pinned, or glued to the speaker basket 106, among other possibilities. In some cases, the gasket 122 may also provide an air-tight seal on the front, cone assembly side of the loudspeaker assembly 100 for acoustic purposes. Other examples are also possible.

Figure 2B:
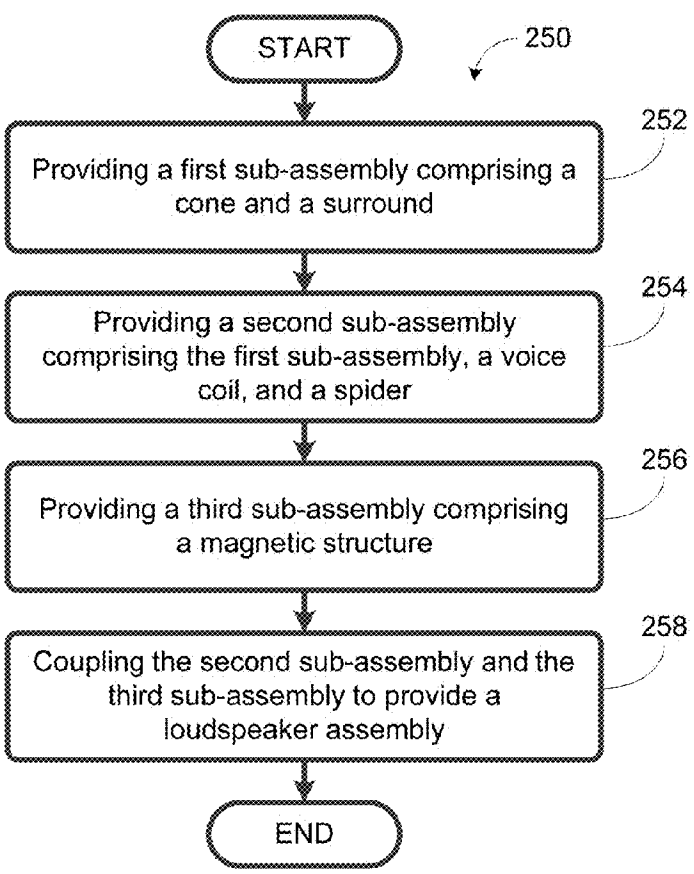
FIGS. 2A and 2B show example methods for providing loudspeaker assemblies.
Figure 2A:
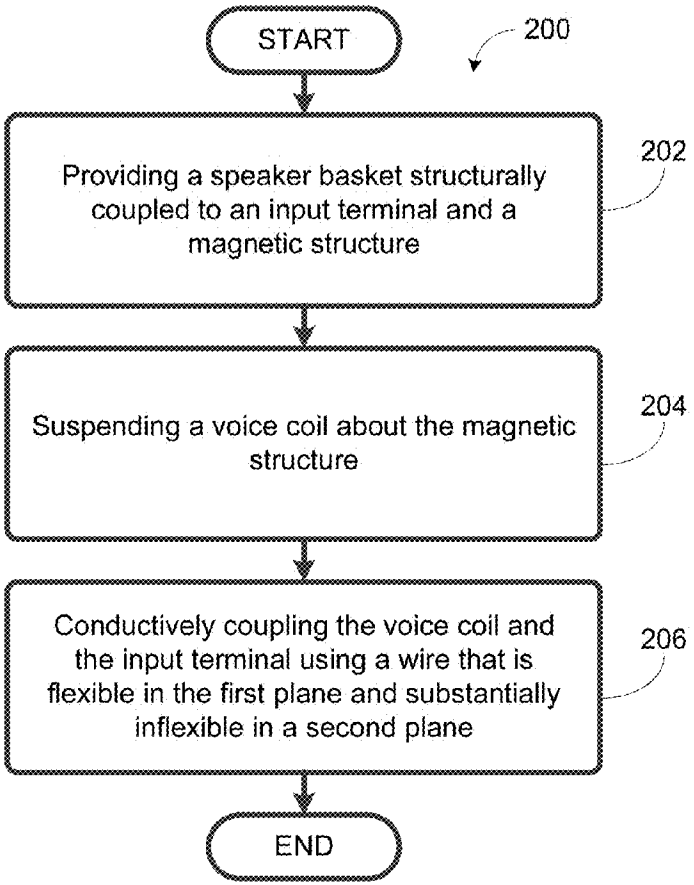

FIGS. 2A and 2B show example methods 200 and 250, respectively, for providing loudspeaker assemblies. Methods 200 and 250 include one or more operations, functions, or actions as illustrated by one or more of blocks 202-206 and 252-258, respectively. Although the blocks are illustrated in respective sequential orders, the blocks may also be performed in parallel, and/or in a different order than those described herein. Also, the various blocks may be combined into fewer blocks, divided into additional blocks, and/or removed based upon the desired implementation. In addition, for the method 200, method 250, and other processes and methods disclosed herein, the flowchart shows functionality and operation of one possible implementation of present embodiments. In this regard, each block may represent a module, a segment, or a portion of program code, which includes one or more instructions executable by a processor for implementing specific logical functions or steps in the process.

The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, each block in FIGS. 2A and 2B may represent circuitry that is wired to perform the specific logical functions in the process.

As shown in FIG. 2A, the method 200 involves providing a speaker basket structurally coupled to an input terminal and a magnetic structure at block 202, suspending a voice coil about the magnetic structure at block 204, and conductively coupling the voice coil and the input terminal using a wire that is flexible in the first plane and substantially inflexible in a second plane at block 206.

At block 202, the method 200 involves providing a speaker basket structurally coupled to an input terminal and a magnetic structure. The speaker basket may be the speaker basket 106 of the loudspeaker assembly 100 of FIG. 1A, the input terminal may be one or both of the input terminals 104*a* and 104*b*, and the magnetic structure may be the magnetic structure discussed above that includes the bottom cup 102, magnet spacer 108*a*, magnet 108*b*, and magnet washer 108*c*. Other examples of the speaker basket, input terminal, and magnetic structure are also possible.

At block 204, the method 200 involves suspending a voice coil about the magnetic structure. The voice coil may be the voice coil 110 of the loudspeaker assembly 100 of FIG. 1A. As indicated above, a spider such as the spider 114 may be provided to maintain a position of the voice coil 110 about the magnetic structure.

At block 206, the method 200 involves conductively coupling the voice coil and the input terminal using a wire that is flexible in a first plane and substantially inflexible in a second plane, such that the wire flexes in the first plane when an electrical signal at the input terminal causes the voice coil to move in an axial direction about the magnetic structure. The wire may be one or both of the wires 116*a* and 116*b* of the loudspeaker assembly 100 of FIG. 1A. As indicated above, the wires 116*a* and 116*b* may be flat wires that are flexible in the first plane and substantially inflexible in the second plane such that, as coupled between the voice coil and the input terminal(s), the flat wire flexes in the first plane when an electrical signal at the input terminal(s) causes the voice coil to move in the axial direction about the magnetic structure. Also as indicated above, the axial direction of movement of the voice coil about the magnetic structure may be within the first plane. Such a configuration may improve a durability of the wire and accordingly, the conductive coupling of the voice coil and the input terminal.

In one example, referring again to FIG. 1A, conductively coupling the voice coil 110 and the input terminals 104*a* and 104*b* using the wires 116*a* and 116*b* may involve soldering the a first end of the wire 116*a* to the voice coil lead 112*a*, and soldering a second end of the wire 116*a* to the input terminal 104*a*; and soldering a first end of the wire 116*b* to the voice coil lead 112*b*, and soldering a second end of the wire 116*b* to the input terminal 104*b*. Alternatively, the input terminals 104*a* and 104*b* and/or the voice coil leads 112*a* and 112*b* may have plug and/or socket structures such that the wires 116*a* and 116*b* may be coupled to the input terminals 104*a* and 104*b*, respectively, and the voice coil leads 112*a* and 112*b*, respectively, without soldering. Other examples are also possible.

The method 250 of FIG. 2B illustrates an example sequence of manufacture for providing a loudspeaker assembly. As shown in FIG. 2B, the method 250 involves providing a first sub-assembly comprising a cone and a surround at block 252, providing a second sub-assembly comprising the first sub-assembly, a voice coil, and a spider at block 254, providing a third sub-assembly comprising a magnetic structure at block 256, and coupling the second sub-assembly and the third sub-assembly to provide a loudspeaker assembly at block 258. In some examples, one or more of block 252, 254, and 256 may be performed in parallel. For instance, in one case, blocks 252 and 256 may be performed in parallel. In another case, blocks 254 and 256 are performed in parallel. Other examples are also possible.

At block 252, the method 250 involves providing a first sub-assembly comprising a cone and a surround. Referring to the loudspeaker assembly 100 of FIG. 1A, block 252 may involve providing the cone assembly 120. As indicated previously, the first sub-assembly may further include a dust cap.

At block 254, the method 250 involves providing a second sub-assembly comprising the first sub-assembly, a voice coil, and a spider. Continuing with the loudspeaker assembly 100 of FIG. 1A, the second sub-assembly may include the cone assembly 120, the spider 114, and the voice coil 110. In other words, the second sub-assembly may be the example loudspeaker sub-assembly 150 of FIG. 1B.

In one example, the spider 114 may attached to the cone assembly 120 by concentrically gluing the inner rim of the spider 114 to the inner/lower surface of the speaker cone. The voice coil 110 may then be concentrically glued to a central portion of the inner/lower surface of the speaker cone. In another example, the voice coil 110 may be glued to the speaker cone before the spider is glued to the speaker cone. Other examples, such as those involving the spider being additionally or alternatively attached to the voice coil, are also possible.

As shown in FIG. 1A, the wires 116*a* and 116*b* may already be at least partially adhered to the spider 114. In another example, the wires 116*a* and 116*b* may be provided independent of the spider 114. Whichever the case, the wires 116*a* and 116*b* may then be soldered (or otherwise conductively coupled) to the voice coil leads 112*a* and 112*b*, respectively. In some cases, the wires 116*a* and 116*b* and/or the voice coil leads 112*a* and 112*b* may also be at least partially adhered to the inner/lower surface of the speaker cone. In one case, as discussed previously, the second sub-assembly may further include the suspension ring 118 that may structurally couple an outer rim of the surround to an outer rim of the spider.

At block 256, the method 250 involves providing a third sub-assembly comprising a magnetic structure. Referring again to the loudspeaker assembly 100 of FIG. 1A and the corresponding discussions above, the magnetic structure may include the bottom cup 102, magnet spacer 108*a*, magnet 108*b*, and magnet washer 108*c*. The magnet spacer 108*a* may be glued to the magnet spacer 108*a*, the magnet spacer 108*a* may be glued to the magnet 108*b*, and the magnet 108*b* may be glued to the magnet washer 108*c*. In one case, each of the gluing steps may be performed using different jigs. In one instance, one or more of the gluing steps of the magnetic structure may alternatively involve adhering of two or more of the magnetic structure components using epoxy. The magnetic structure may be configured to be structurally coupled to the speaker basket 106. Other examples are also possible.

At block 258, the method 250 involves coupling the second sub-assembly and the third sub-assembly to provide a loudspeaker assembly. In one example, coupling the second sub-assembly and the third sub-assembly may involve suspending the voice coil about the magnetic structure, and conductively coupling the wires 116*a* and 116*b* to the input terminals 114*a* and 114*b*, respectively.

In one case, coupling the second sub-assembly and the third sub-assembly may involve first coupling the second sub-assembly to the speaker basket 106, which may already have the input terminals 104*a* and 104*b* structurally coupled thereto. As indicated previously, the second sub-assembly may be coupled to the speaker basket 106 via the suspension ring 118. The input terminals 104*a* and 104*b* may be coupled to the speaker basket 106 by press-fitting or soldering, among other possibilities. The speaker basket 106, now coupled to the second sub-assembly may then be coupled to the magnetic structure of the third sub-assembly.

In another case, coupling the second sub-assembly and the third sub-assembly may involve first coupling the magnetic structure of the third sub-assembly to the speaker basket 106. The second sub-assembly may then be coupled to the speaker basket 106, which is already coupled to the third sub-assembly. As indicated previously, the second sub-assembly may be coupled to the speaker basket 106 via the suspension ring 118. Other examples are also possible.

Figure 3B:
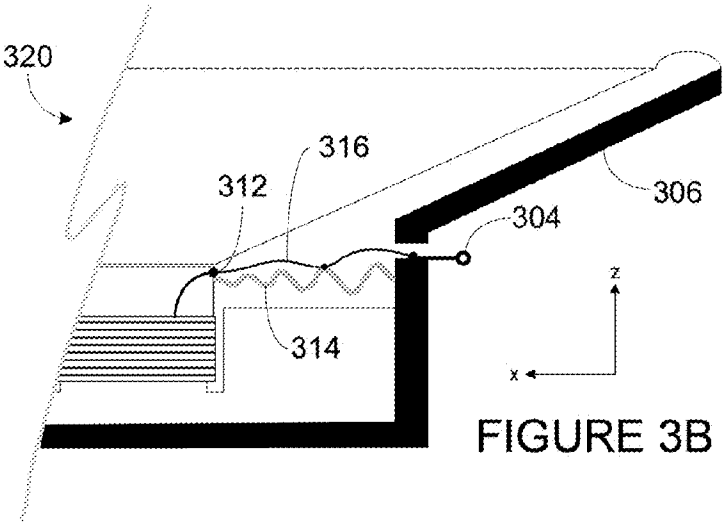
FIGS. 3A, 3B, 3C, and 3D show additional illustrative examples of voice coil connection configurations.
Figure 3A:
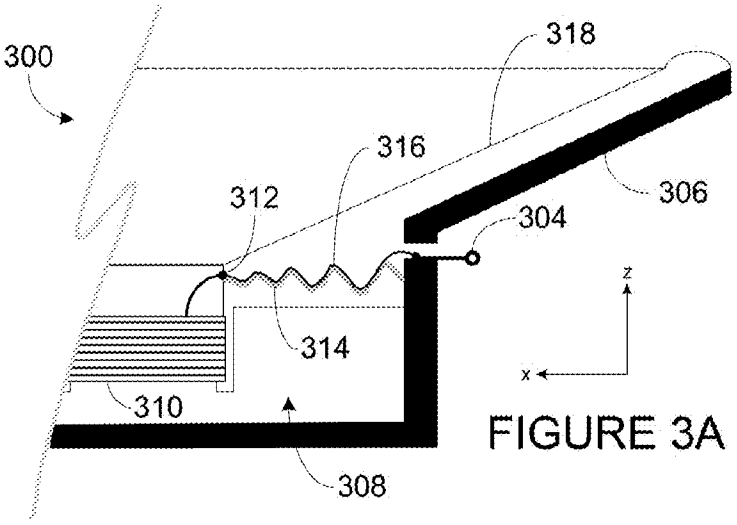

FIGS. 3A-3D show additional illustrative examples of voice coil connections. FIG. 3A shows a loudspeaker assembly 300 that includes a speaker basket 306, a magnetic structure 308, a voice coil 310, a voice coil lead 312, a spider 314, a wire 316, and a speaker cone 318. Referring back to FIGS. 1A and 1B, the speaker basket 306 may be similar to the speaker basket 106, the magnetic structure 308 may be similar to the magnetic structure including the bottom cup 102, magnet spacer 108*a*, magnet 108*b*, and magnet washer 108*c*, the voice coil may be similar to the voice coil 110, the voice coil lead 312 may be similar to the voice coil leads 112*a* and 112*b*, the spider may be similar to the spider 114, the wire 316 may be similar to the wires 116*a* and 116*b*, and the speaker cone 118 may be similar to the speaker cone of the cone assembly 120.

The wire 316 couples the voice coil lead 312 to the terminal 314, and the voice coil 310 may be suspended about the magnetic structure 308, and configured to move axially along the magnetic structure 308 in the z-axis. The wire 316 may be a flat wire that, as implemented, is flexible in the x-z plane, and substantially inflexible in the x-y plane. As such, the wire 316 may be flexible along the x-z plane during operation of the loudspeaker 300 when the voice coil 310 is moving axially along the z-axis.

As shown in FIG. 3A, the wire 316 may be substantially coupled along the spider 314. For instance, a substantial length of the wire 316 may be adhered (laminated or glued, among other possibilities) to a surface of the spider 314. Referring to the method 250 of FIG. 2B, block 254 may involve adhering the wire 316 to at least a portion of the spider 314 and providing the spider 314 with the substantial length of the wire 316 already adhered thereto before gluing the spider 314 to the speaker cone 318 and/or voice coil 310, and conductively coupling the wire 316 to the voice coil lead 312.

In one example, a subset of the substantial length of the wire 316 may be adhered to the surface of the spider 314 prior to gluing the spider 314 to the speaker cone, and the remaining substantial length of the wire 316 may be adhered to the surface of the spider 314 once the spider 314 has been adhered to the speaker cone 318 and/or voice coil 310, and the wire 315 has been coupled to the voice coil lead 312. In this example, the remaining substantial length of the wire 316 may provide slack in the wire 316 when gluing the spider 314 to the speaker cone 318 and/or voice coil 310. The slack may provide room for manipulating and positioning the components within the speaker basket 306 during manufacture and assembly.

FIG. 3B shows a loudspeaker 320 similar to the loudspeaker 300. As shown in FIG. 3B, a substantial length of the wire 316 may not be adhered to the surface of the spider 314. Instead, only a short segment (or alternatively, a few short segments) of the wire 316 is adhered to the surface of the spider 314. Similar to the loudspeaker 300, block 254 of the method 250 of FIG. 2B may involve adhering the wire 316 to at least a portion of the spider 314 and providing the spider 314 with the wire 316 already at least partially adhered thereto (similar to the spider 114 of FIGS. 1A and 1B) before gluing the spider to the speaker cone 318 and conductively coupling the wire 316 to the voice coil lead 312.

Figure 3D:
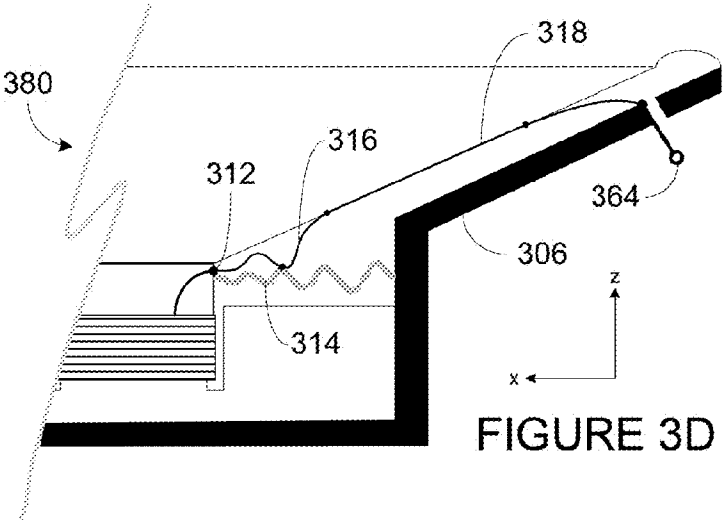
Figure 3C:
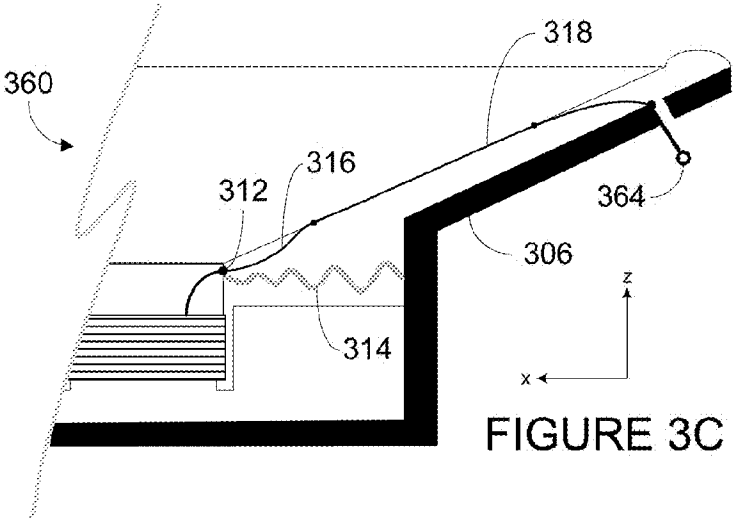

FIG. 3C shows a loudspeaker 360 similar to the loudspeakers 300 and 320. The loudspeaker 360, however, has a terminal 364 positioned in a different position relative to the speaker basket 306, than the terminal 314 of FIGS. 3A and 3B. As shown, the terminal 364 may be positioned farther from where an outer rim of the spider 314 is structurally coupled to the speaker basket 306 than the terminal 314 of FIGS. 3A and 3B.

In this case, the wire 316 may be at least partially adhered to a surface of the cone 318. Referring back the method 250, and in contrast to the discussions of block 254 of the method 250 in connection to FIGS. 3A and 3B, the wire 316 may be provided as part of block 252, when the first sub-assembly including the speaker cone 318 is provided. Accordingly, in this case, block 252 of the method 250 may involve adhering the wire 316 to at least a portion of the speaker cone 318 and providing the speaker cone 318 with the wire 316 already at least partially adhered thereto before providing the second sub-assembly at block 254.

Similar to that discussed above in connection to FIG. 3A, a subset of the to-be-adhered length of the wire 316 may be adhered to the surface of the speaker cone 318 prior to block 254, and the remaining portion of the to-be-adhered length of the wire 316 may be adhered to the surface of the speaker cone 318 during block 254.

FIG. 3D shows a loudspeaker 380 similar to the loudspeaker 360. As shown in FIG. 3D, the wire 316 of the loudspeaker 308 may be adhered to both the spider 314 and the speaker cone 318. In one example, the spider 314 may be provided at block 254 of the method 250 with a first portion of the wire 316 already adhered thereto, similar to that described above in connection to FIGS. 1A-1B, 2A-2B, and 3A-3B. In this case, block 254 may further involve adhering a second portion of the wire 316 to the speaker cone 318. In another example, the speaker cone 318 may be provided at block 252 of the method 250 with a first portion of the wire 316 already adhered thereto, and block 254 may involve adhering a second portion of the wire 316 to the spider 314 when providing the second sub-assembly.

While FIGS. 3A-3D generally show the wire 316 as being present in a space between the spider 314 and the speaker cone 318, adhered to one or both the spider 314 and the speaker cone 318, one having ordinary skill in the art will appreciate that other configurations are also possible. In one case, the wire may not be adhered to the speaker cone 318 and the spider 314 and may simply dangle between the terminal 304/364 and the voice coil lead 312.

In another case, the wire 316 may conductively couple the voice coil lead 312 with the terminal 304/364 in a space between the spider 314 and the magnetic structure. In such a case, the wire may at least partially adhered to a lower surface of the spider 314, or not adhered to any component of the loudspeakers 300, 320, 360, and 308 between the voice coil lead 312 and the terminal 304/364.

In yet another case, the wire 316 may be routed through one or both of the speaker cone 318 and spider 314. For instance, the wire 316 may be coupled to the voice coil lead 312 at a location below where the inner rim of the spider 314 is coupled to the voice coil 310 and/or speaker cone 318, pass through the spider 314, and be coupled to the terminal 304/364 through the space between the speaker cone 318 and the spider 314. In this instance, the wire 316 may be at least partially adhered to one, both, or neither of the speaker cone 318 and the spider 314. Likewise, the wire 316 may additionally, or alternatively pass through the speaker cone 118 once or twice between where the wire 316 is coupled to the voice coil lead 312 and the terminal 304/364. Other examples are also possible.

Figure 4A:
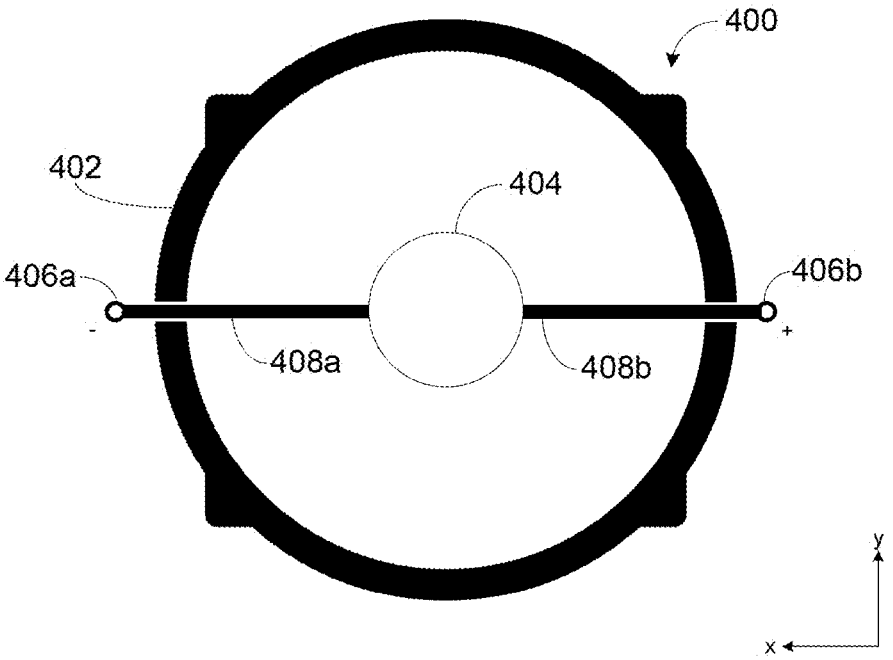
FIGS. 4A and 4B show illustrative examples of voice coil connections.

FIG. 4A shows an example loudspeaker 400. As shown, the loudspeaker configuration 400 includes a speaker basket 402, a voice coil 404, terminals 406*a* and 406*b*, and wires 408*a* and 408*b*. Referring back to FIG. 1A, the speaker basket 402 may be similar to the speaker basket 106, the voice coil 404 may be similar to the voice coil 110, and the terminals 406*a* and 406*b* may be similar to the terminals 104*a* and 104*b*.

Like the loudspeaker assembly 100 of FIG. 1A, the loudspeaker 400 has terminals 406*a* and 406*b* that are on opposite sides of the loudspeaker 400, or approximately 180 degrees apart. In some cases, the separation of the terminals 406*a* and 406*b* may be partially due to a location of electric signal inputs within a playback device within which the loudspeaker 400 is to be installed. In some other cases, the separation of the terminals 406*a* and 406*b* may be partially to prevent tangling or short circuiting between the wires 408*a* and 408*b* during operation of the loudspeaker 400.

For instance, if the wires 408*a* and 408*b* are omni-flexible wires (e.g. generic conductive wire), the wires 408*a* and 408*b* may flex in various directions during operation of the loudspeaker 400 from axial movement of the voice coil in the z-axis, and may potentially move in a "jump-rope" motion. As such, placing the terminals 406*a* and 406*b*, and accordingly the wires 408*a* and 408*b* on opposite sides of the loudspeaker basket 402 (or otherwise physically remote from each other) may be necessary to prevent tangling or sort circuiting of the wires 408*a* and 408*b*. On the other hand, if the wires 408*a* and 408*b*, like the wires 116*a* and 116*b* of FIGS. 1A and 1B are wires that are flexible in a first plane, and substantially inflexible in a second plane, the terminals 406*a* and 406*b*, and the wires 408*a* and 408*b* may not need to be positioned as remotely from each other.

Figure 4B:
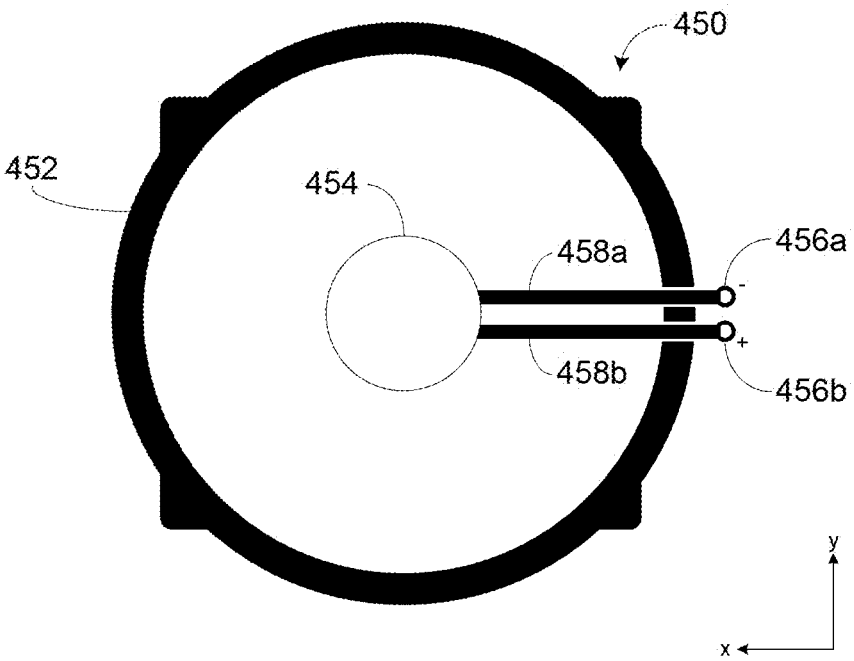

FIG. 4B shows an example loudspeaker 450. As shown, the loudspeaker configuration 450 includes a speaker basket 452, a voice coil 454, terminals 456*a* and 456*b*, and wires 458*a* and 458*b*. Referring back to FIG. 1A, the speaker basket 452 may be similar to the speaker basket 106, the voice coil 454 may be similar to the voice coil 110, the terminals 456*a* and 456*b* may be similar to the terminals 104*a* and 104*b*, and the wires 458*a* and 458*b* may be similar to the wires 116*a* and 116*b*, respectively. In contrast to the loudspeaker assembly 100 and the loudspeaker 400, the loudspeaker 450 has a speaker basket 452 with terminals 456*a* and 456*b* substantially adjacent to each other, such that the wires 458*a* and 458*b* are also positioned substantially adjacent to each other.

In this example, the wires 458*a* and 458*b* may be similar to the wires 116*a* and 116*b* of FIGS. 1A and 1B, and may be wires that are flexible in a first plane (the x-z plane), and substantially inflexible in a second plane (the x-y plane). Accordingly, during operation of the loudspeaker 450, the wires 458*a* and 458*b* may flex in the x-z plane along with the axial movement of the voice coil 454 along the z-axis, but flex only minimally in the x-y plane. As such, the terminals 406*a* and 406*b* may be positioned closer to each other with minimal risk of short circuiting or tangling between the wires 408*a* and 408*b*. In some cases, as compared to terminals 406*a* and 406*b* of FIG. 4A, adjacent or substantially adjacent terminals 456*a* and 456*b* may provide more convenient signal and wire routing within a playback device, between an audio source and the terminals 456*a* and 456*b*.

One having ordinary skill in the art will appreciate that in addition to potentially increased durability and potentially more convenient signal and wire routing, coupling loudspeaker input terminals to the voice coil leads using wires that are flexible in a first plane and substantially inflexible in a second plane may provide other benefits as well. For instance, a flat wire that is flexible in a first plane and substantially inflexible in the second plane may also have a slimmer, or flatter profile than a generic omni-flexible wire (e.g. braided wires). As such, use of such a flat wire that is flexible in the direction of axial movement of the voice coil may reduce the clearance height required between two or more of a magnetic structure, a spider, and a speaker cone in a loudspeaker, thereby allowing for a slimmer, shallower loudspeaker assembly. In an illustrative example, the use of such a flat wire instead of a braided wire may allow for a loudspeaker assembly that is 2-4 mm shallower. Other examples are also possible.

III. Example Media Playback Device

Figure 5:
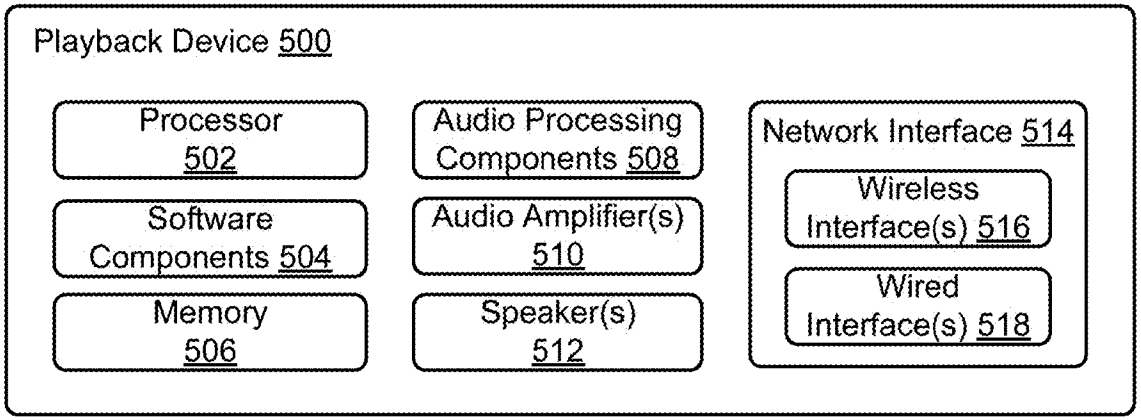
FIG. 5 shows a functional block diagram of a media playback device.

FIG. 5 shows a functional block diagram of a media playback device 500 within which one or more loudspeakers such as those discussed in the previous sections may be implemented. The media playback device 500 may include a processor 502, software components 504, memory 506, audio processing components 508, audio amplifier(s) 510, speaker(s) 512, and a network interface 514 including wireless interface(s) 516 and wired interface(s) 518. The speaker (s) 512 may include one or more of the speaker assemblies and/or speaker arrays discussed in the previous sections. As indicated above, one or more of the components of the media playback device 500 may be designed and/or implemented to account for any predictable electromagnetic fields created when an audio signal is provided to the speaker(s) 512. For instance, an antenna of the wireless interface(s) 516 may be configured based on the predictable electromagnetic fields.

In one example, the processor 502 may be a clock-driven computing component configured to process input data according to instructions stored in the memory 506. The memory 506 may be a tangible computer-readable medium configured to store instructions executable by the processor 502. For instance, the memory 506 may be data storage that can be loaded with one or more of the software components 504 executable by the processor 502 to achieve certain functions. In one example, the functions may involve the media playback device 500 retrieving audio data from an audio source or another media playback device. In another example, the functions may involve the media playback device 500 sending audio data to another device or media playback device on a network. In yet another example, the functions may involve pairing of the media playback device 500 with one or more media playback devices to create a multi-channel audio environment.

Certain functions may involve the media playback device 500 synchronizing playback of audio content with one or more other media playback devices. During synchronous playback, a listener will preferably not be able to perceive time-delay differences between playback of the audio content by the media playback device 500 and the one or more other media playback devices. U.S. Pat. No. 8,234,395 entitled, "System and method for synchronizing operations among a plurality of independently clocked digital data processing devices," which is hereby incorporated by reference, provides in more detail some examples for audio playback synchronization among media playback devices.

The memory 506 may further be configured to store data associated with the media playback device 500, such as one or more zones and/or zone groups the media playback device 500 may be a part of, audio sources accessible by the media playback device 500, or a playback queue that the media playback device 500 (or some other media playback device) may be associated with. The data may be stored as one or more state variables that are periodically updated and used to describe the state of the media playback device 500. The memory 506 may also include the data associated with the state of the other devices of the media system, and shared from time to time among the devices so that one or more of the devices have the most recent data associated with the system. Other embodiments are also possible.

The audio processing components 508 may include one or more digital-to-analog converters (DAC), an audio preprocessing component, an audio enhancement component or a digital signal processor (DSP), and so on. In one embodiment, one or more of the audio processing components 508 may be a subcomponent of the processor 502. In one example, audio content may be processed and/or intentionally altered by the audio processing components 508 to produce audio signals. The produced audio signals may then be provided to the audio amplifier(s) 510 for amplification and playback through speaker(s) 512. Particularly, the audio amplifier(s) 510 may include devices configured to amplify audio signals to a level for driving one or more of the speakers 512. The speaker(s) 512 may include an individual speaker (e.g., a "driver") or a complete speaker system involving an enclosure with one or more drivers. A particular driver of the speaker(s) 512 may include, for example, a subwoofer (e.g., for low frequencies), a mid-range driver (e.g., for middle frequencies), and/or a tweeter (e.g., for high frequencies). In some cases, each speaker in the one or more speakers 512 may be driven by an individual corresponding audio amplifier of the audio amplifier(s) 510. In addition to producing analog signals for playback by the media playback device 500, the audio processing components 508 may be configured to process audio content to be sent to one or more other media playback devices for playback.

Audio content to be processed and/or played back by the media playback device 500 may be received from an external source, such as via an audio line-in input connection (e.g., an auto-detecting 3.5 mm audio line-in connection) or the network interface 514.

The network interface 514 may be configured to facilitate a data flow between the media playback device 500 and one or more other devices on a data network. As such, the media playback device 500 may be configured to receive audio content over the data network from one or more other media playback devices in communication with the media playback device 500, network devices within a local area network, or audio content sources over a wide area network such as the Internet. In one example, the audio content and other signals transmitted and received by the media playback device 500 may be transmitted in the form of digital packet data containing an Internet Protocol (IP)-based source address and IP-based destination addresses. In such a case, the network interface 514 may be configured to parse the digital packet data such that the data destined for the media playback device 500 is properly received and processed by the media playback device 500.

As shown, the network interface 514 may include wireless interface(s) 516 and wired interface(s) 518. The wireless interface(s) 516 may provide network interface functions for the media playback device 500 to wirelessly communicate with other devices (e.g., other media playback device(s), speaker(s), receiver(s), network device(s), control device(s) within a data network the media playback device 500 is associated with) in accordance with a communication protocol (e.g., any wireless standard including IEEE 802.11a, 802.11b, 802.11g, 802.11n, 802.11ac, 802.15, 4G mobile communication standard, and so on). The wired interface(s) 518 may provide network interface functions for the media playback device 500 to communicate over a wired connection with other devices in accordance with a communication protocol (e.g., IEEE 802.3). While the network interface 514 shown in FIG. 5 includes both wireless interface(s) 516 and wired interface(s) 518, the network interface 514 may in some embodiments include only wireless interface(s) or only wired interface(s). As indicated above, some components of the wireless interface(s) 516, such as an antenna may be designed based on any predictable electromagnetic fields created when an audio signal is provided to the speaker(s) 512.

In one example, the media playback device 500 and one other media playback device may be paired to play two separate audio components of audio content. For instance, media playback device 500 may be configured to play a left channel audio component, while the other media playback device may be configured to play a right channel audio component, thereby producing or enhancing a stereo effect of the audio content. The paired media playback devices (also referred to as "bonded media playback devices") may further play audio content in synchrony with other media playback devices.

In another example, the media playback device 500 may be sonically consolidated with one or more other media playback devices to form a single, consolidated media playback device. A consolidated media playback device may be configured to process and reproduce sound differently than an unconsolidated media playback device or media playback devices that are paired, because a consolidated media playback device may have additional speaker drivers through which audio content may be rendered. For instance, if the media playback device 500 is a media playback device designed to render low frequency range audio content (i.e. a subwoofer), the media playback device 500 may be consolidated with a media playback device designed to render full frequency range audio content. In such a case, the full frequency range media playback device, when consolidated with the low frequency media playback device 500, may be configured to render only the mid and high frequency components of audio content, while the low frequency range media playback device 500 renders the low frequency component of the audio content. The consolidated media playback device may further be paired with a single media playback device or yet another consolidated media playback device.

By way of illustration, SONOS, Inc. presently offers (or has offered) for sale certain media playback devices including a "PLAY:1," "PLAY:3," "PLAY:5," "PLAYBAR," "CONNECT:AMP," "CONNECT," and "SUB." Any other past, present, and/or future media playback devices may additionally or alternatively be used to implement the media playback devices of example embodiments disclosed herein. Additionally, it is understood that a media playback device is not limited to the example illustrated in FIG. 5 or to the SONOS product offerings. For example, a media playback device may include a wired or wireless headphone. In another example, a media playback device may include or interact with a docking station for personal mobile media playback devices. In yet another example, a media playback device may be integral to another device or component such as a television, a lighting fixture, or some other device for indoor or outdoor use. Other examples are also possible.

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

We claim:

1. A loudspeaker, comprising:

a magnetic structure;

a voice coil magnetically suspended about the magnetic structure and configured to move axially about the magnetic structure in response to an electric signal provided to the voice coil;

a speaker cone having a central portion coupled to the voice coil;

a spider configured to maintain a position of the voice coil about the magnetic structure when no electric current is provided to the voice coil, wherein the spider has a first portion opposite a second portion such that the first portion faces toward the speaker cone, and the second portion faces away from the speaker cone; and a wire flexible in a first plane that is parallel to axial movement of the voice coil and substantially inflexible in a second plane that is orthogonal to the first plane such that, during axial movement of the voice coil, the wire flexes in the first plane and does not substantially flex in the second plane, wherein the wire conductively couples an input terminal to the voice coil, and wherein the wire is at least partially adhered to a surface of the second portion of the spider.

2. The loudspeaker of claim 1, wherein the wire is laminated within a non-conductive substance.

3. The loudspeaker of claim 1, wherein the wire is at least partially adhered to a surface of the speaker cone.

4. The loudspeaker of claim 1, wherein an inner rim of the spider is structurally coupled to the voice coil.

5. The loudspeaker of claim 1, wherein an inner rim of the spider is structurally coupled to a lower surface of a speaker cone.

6. The loudspeaker of claim 1, wherein the wire is at least partially adhered to a surface of the speaker cone.

7. The loudspeaker of claim 1, wherein the wire comprises a flat wire.

8. The loudspeaker of claim 7, wherein the axial movement of the voice coil is within the first plane.

9. A method of constructing a loudspeaker, the method comprising:

providing a speaker basket structurally coupled to an input terminal and a magnetic structure;

suspending a voice coil about the magnetic structure;

attaching a central portion of a speaker cone to the voice coil;

structurally coupling an inner rim of a spider to the voice coil, wherein the spider is configured to maintain a position of the voice coil about the magnetic structure when no electric current is provided to the voice coil, and wherein the spider has a first portion opposite a second portion such that the first portion faces toward the speaker cone, and the second portion faces away from the speaker cone;

conductively coupling the voice coil and the input terminal using a wire that is flexible in a first plane that is parallel to axial movement of the voice coil and substantially inflexible in a second plane that is orthogonal to the first plane, such that the wire flexes in the first plane and does not substantially flex in the second plane when an electrical signal at the input terminal causes the voice coil to move in an axial direction about the magnetic structure; and adhering at least a portion of the wire to a surface of the second portion of the spider.

10. The method of claim 9, further comprising:

laminating the wire in a non-conductive substance.

11. The method of claim 9, further comprising:

adhering at least a portion of the wire to a surface of a speaker cone; and structurally coupling an outer rim of the speaker cone to the speaker basket via a surround.

12. The method of claim 9, further comprising:

structurally coupling an outer rim of the spider to the speaker basket.

13. The method of claim 12, further comprising:

structurally coupling an inner rim of the spider to a lower surface of a speaker cone; and structurally coupling an outer rim of the speaker cone to the speaker basket via a surround.

14. An loudspeaker comprising:

an input terminal;

a speaker basket structurally coupled to the input terminal;

a magnetic structure structurally coupled to the speaker basket;

a voice coil magnetically suspended about the magnetic structure and configured to move axially about the magnetic structure in response to an electric signal received via the input terminal;

a speaker cone having a central portion coupled to the voice coil;

a spider configured to maintain a position of the voice coil about the magnetic structure when no electric current is provided to the voice coil, wherein the spider has a first portion opposite a second portion such that the first portion faces toward the speaker cone, and the second portion faces away from the speaker cone; and a wire flexible in a first plane that is parallel to axial movement of the voice coil, and substantially inflexible in a second plane that is orthogonal to the first plane such that, during axial movement of the voice coil, the wire flexes in the first plane and does not substantially flex in the second plane, wherein the wire conductively couples the input terminal to the voice coil, and wherein the wire is at least partially adhered to a surface of the second portion of the spider.

15. The loudspeaker of claim 14, wherein the wire is laminated within a non-conductive substance.

16. The loudspeaker of claim 14, wherein the speaker cone further comprises:

an outer rim coupled to the speaker basket via a surround, wherein the wire is at least partially adhered to a surface of the speaker cone.

17. The loudspeaker of claim 14, wherein the axial movement of the voice coil is within the first plane.

18. The loudspeaker of claim 14, wherein the wire is a first wire, the loudspeaker further comprising:

an output terminal structurally coupled to the speaker basket; and a second wire flexible in the first plane, and substantially inflexible in the second plane, wherein the wire conductively couples the output terminal to the voice coil such that the wire flexes in the first plane during axial movement of the voice coil.

19. The loudspeaker of claim 18, wherein the input terminal and the output terminal are separated by an azimuthal angle less than 180 degrees.

20. The loudspeaker of claim 18, wherein the first wire and the second wire are substantially parallel.

* * * * *